US007084341B2

(12) United States Patent
Barr

(10) Patent No.: US 7,084,341 B2
(45) Date of Patent: Aug. 1, 2006

(54) SOUND PICKUP SYSTEM FOR ACOUSTIC STRING INSTRUMENTS

(76) Inventor: Damon A. Barr, 1734 Sheldon Ave., Medford, OR (US) 97501

( * ) Notice: Subject to any disclaimer, the term of this patent is extended or adjusted under 35 U.S.C. 154(b) by 48 days.

(21) Appl. No.: 10/757,950

(22) Filed: Jan. 14, 2004

(65) Prior Publication Data

US 2004/0159225 A1 Aug. 19, 2004

Related U.S. Application Data

(60) Provisional application No. 60/439,621, filed on Jan. 14, 2003.

(51) Int. Cl.
*G10H 1/32* (2006.01)

(52) U.S. Cl. ..... 84/743; 84/279; 84/725

(58) Field of Classification Search ..... 84/743, 84/731, 1, 274, 279
See application file for complete search history.

(56) References Cited

U.S. PATENT DOCUMENTS

| | | | | |
|---|---|---|---|---|
| 2,486,264 A * | 10/1949 | De Armond | 84/725 |
| 4,534,259 A * | 8/1985 | Wolf | 84/279 |
| 4,785,704 A | 11/1988 | Fishman | 84/1.16 |
| 4,805,510 A | 2/1989 | DeDianous | 84/1.16 |
| 4,951,541 A | 8/1990 | McMillan | 84/280 |
| 5,191,159 A * | 3/1993 | Jordan | 84/274 |
| 5,229,537 A | 7/1993 | Kennedy | 84/727 |
| 5,415,070 A * | 5/1995 | Kaman | 84/279 |
| 5,614,688 A | 3/1997 | Donnell | 84/743 |
| 5,945,622 A * | 8/1999 | Yamada | 84/731 |
| 6,018,120 A * | 1/2000 | Steinberger | 84/731 |
| 6,239,349 B1 | 5/2001 | Fishman | 84/731 |
| 6,268,555 B1 * | 7/2001 | Vochezer | 84/279 |
| 6,278,059 B1 | 8/2001 | Lefton | 174/50 |
| 6,288,320 B1 * | 9/2001 | Murakami et al. | 84/622 |
| 6,429,367 B1 | 8/2002 | Fishman | 84/730 |

* cited by examiner

*Primary Examiner*—Jeffrey Donels
*Assistant Examiner*—Christina Russell
(74) *Attorney, Agent, or Firm*—Pedersen & Co., PLLC; Ken J. Pedersen; Barbara S. Pedersen

(57) ABSTRACT

A sound pickup system for string instruments includes a chinrest and/or tailpiece connected to a first audio interface device—e.g. a piezoelectric transducer-on the instrument's bridge. A second audio interface device—e.g., a microphone-may be attached to and extended from the chinrest and/or tailpiece to provide a second sound pickup mechanism, which improves the quality of the sound reproduced by the sound pickup system. The chinrest and/or tailpiece contains volume and sensitivity control, for one or both audio interface devices, that also acts as a high frequency noise filter; a human grounding point in the chin cup and/or in the strings; and an output jack.

13 Claims, 8 Drawing Sheets

SOUND PICKUP SYSTEM FOR ACOUSTIC STRING INSTRUMENTS

PRIORITY CLAIM

This application incorporates by reference the entire disclosure of U.S. provisional application No. 60/439,621 filed on Jan. 14, 2003 and entitled "Electrified Violin Chinrest" and claims priority of the same.

BACKGROUND OF THE INVENTION

1. Field of the Invention

The invention relates to devices used to pickup and amplify the sound from string instruments, and more particularly to such a device incorporated into a violin chinrest.

2. Related Art

It is often desirable to amplify the sound of a string instrument, such as a violin. This is generally accomplished in one of two ways: by attaching a sound pickup system to an acoustic instrument and amplifying the signal therefrom or by using an "electric" instrument, such as the ubiquitous electric guitar. Electric instruments are often undesirable because they produce a more synthetic sound than traditional acoustic instruments.

For violins, there are three general types of devices that comprise the bulk of the prior art. All involve the attachment of at least some type of cable and microphone to various parts of the violin. First, a ⅛" female phone output jack is mounted to the tailpiece by a zip-tie plastic strap fastener or similar means, placing the cord in an inconvenient location for the user. This type of device also lacks volume control and is not grounded.

Second, a ¼" mono female phone output jack is housed in a block that is attached to the body of the instrument on the left side with a turnbuckle clamp, adversely impacting the sound quality. The size of the jack also adds mass to the violin, which inhibits vibration to the detriment of sound production.

Third, a ¼" mono female phone jack is mounted on a thin metal plate which is screwed into the left side rib of the instrument, permanently damaging the instrument and adversely impacting the sound quality. The violin rib is thin and fragile, and cannot vibrate properly with a metal plate attached to it. With this type of device, a volume control knob may be attached to the top of the instrument, further obstructing vibration and distorting the sound.

These types of devices have an undesirable effect on the sound produced because they interfere with the acoustic vibration of the instrument body. Also, none of these instruments is fully grounded, which means that electrical background noise—i.e., buzz-is introduced. Therefore, there is a need for an effective amplification system for acoustic string instruments—e.g., violins, cellos, and guitars-that effectively picks up and reproduces the sound without distorting the sound or introducing electrical background noise.

SUMMARY OF THE INVENTION

A sound pickup system is built into a string instrument chinrest and/or tailpiece. The placement of the sound pickup system in the chinrest virtually eliminates interference with the vibration of the violin body, a critical factor in the creation and tone of the music, because the only interference comes from the chinrest, which would be present without the invented sound pickup system.

The preferred embodiment includes volume and sensitivity control. This control acts as a high frequency filter, eliminating excessive high frequencies and bow noises to provide a more natural tone that with conventional devices. Preferably, the control knob is teardrop-shaped so that the user can easily determine and adjust the setting by feel only.

The preferred chinrest includes a human grounding point. Preferably, the grounding point includes a copper insert in the chinrest that contacts the player's chin. A second grounding point is established at the strings to insure a completely grounded condition during play. This combination of features creates an effective sound pickup system that is minimally invasive and disruptive, unobtrusive, and aesthetically pleasing.

DETAILED DESCRIPTION OF THE INVENTION

Referring to the figures, there are shown some, but not the only, embodiments of the invented sound pickup system. The preferred embodiment adapts a conventional violin or viola chinrest to incorporate a sound pickup system. The invention may also be incorporated into the tailpiece of a string instrument, such as a violin, viola, cello, bass, guitar, or mandolin. In a string instrument having a chinrest and tailpiece, components may be incorporated into both. By incorporating sound pickup, volume and sensitivity control, and grounding in a mounting device that is already attached to the instrument, the invented sound pickup system is attached to the instrument with much less impact on sound creation than with prior devices. This also minimizes the need to permanently or temporarily alter the body (B) of the instrument (I) any way-minor modifications to the bridge and/or tailpiece, but not the body (B) may be required. The invention minimizes extraneous mass or pressure being place on the instrument and eliminates the necessity to alter the body of the instrument in any way. See FIG. 14.

Figure 1:
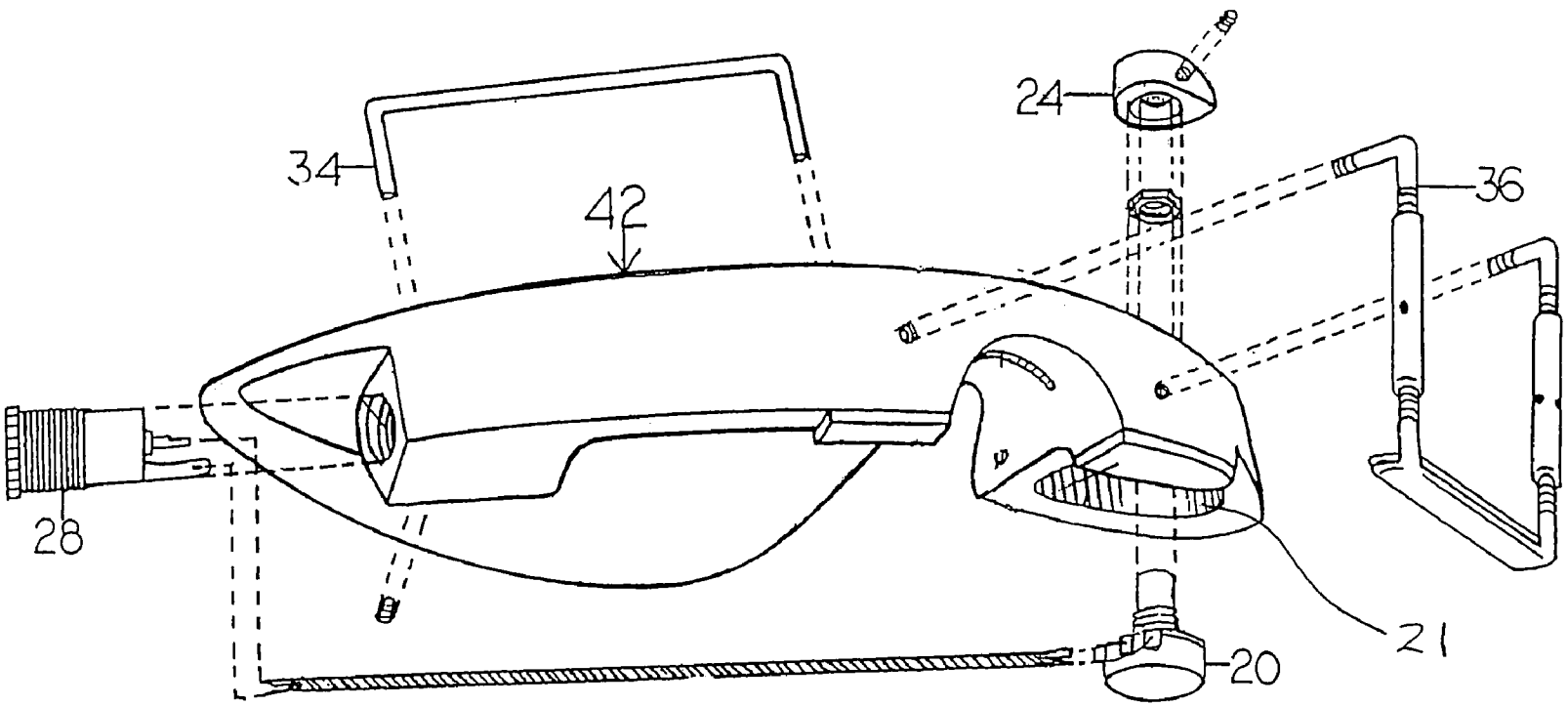
FIG. 1 is an exploded bottom rear perspective view of the preferred embodiment of the invented sound pickup system incorporated into a Guarnerius style violin or viola chinrest.
Figure 2:
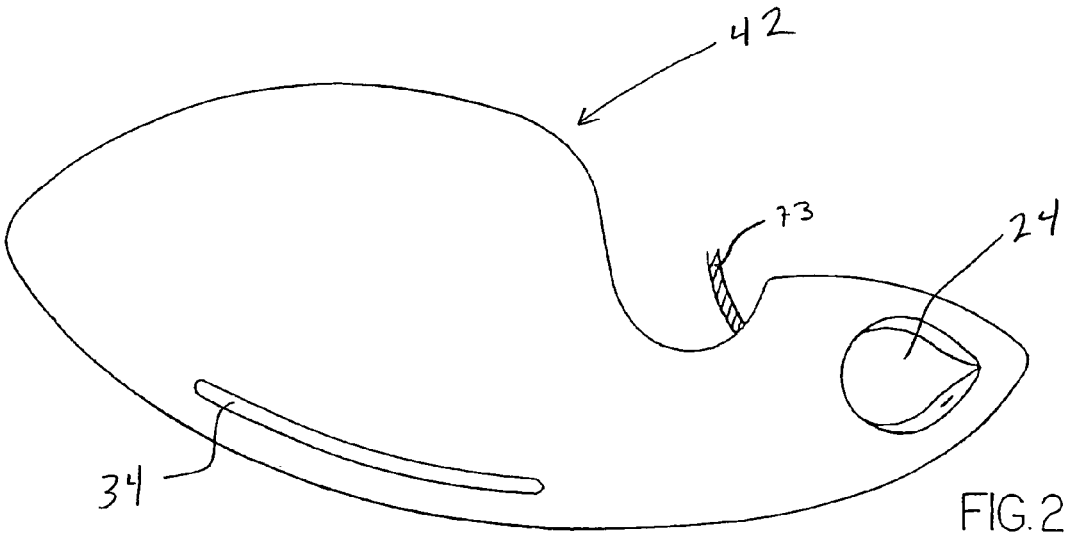
FIG. 2 is a top view of the embodiment of FIG. 1.
Figure 3:
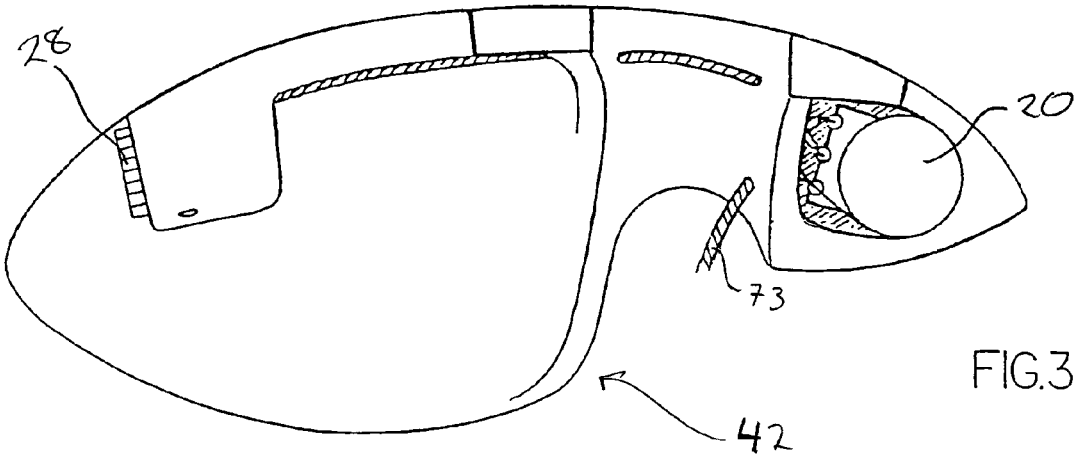
FIG. 3 is a bottom view of the embodiment of FIGS. 1 and 2.
Figure 4:
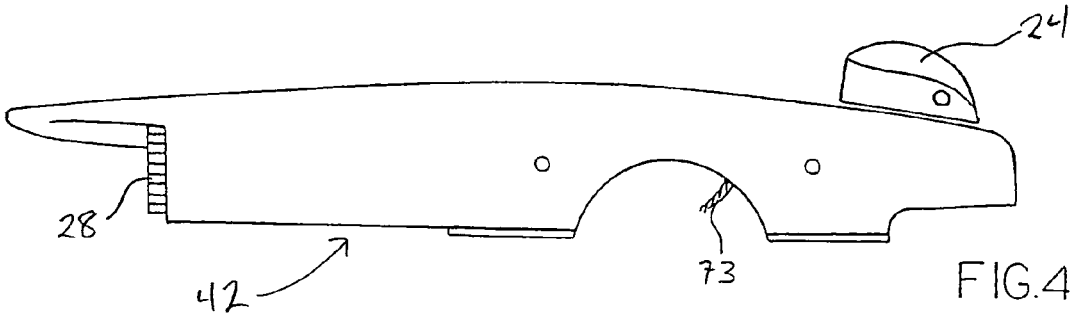
FIG. 4 is a rear view of the embodiment of FIGS. 1, 2, and 3.
Figure 5:
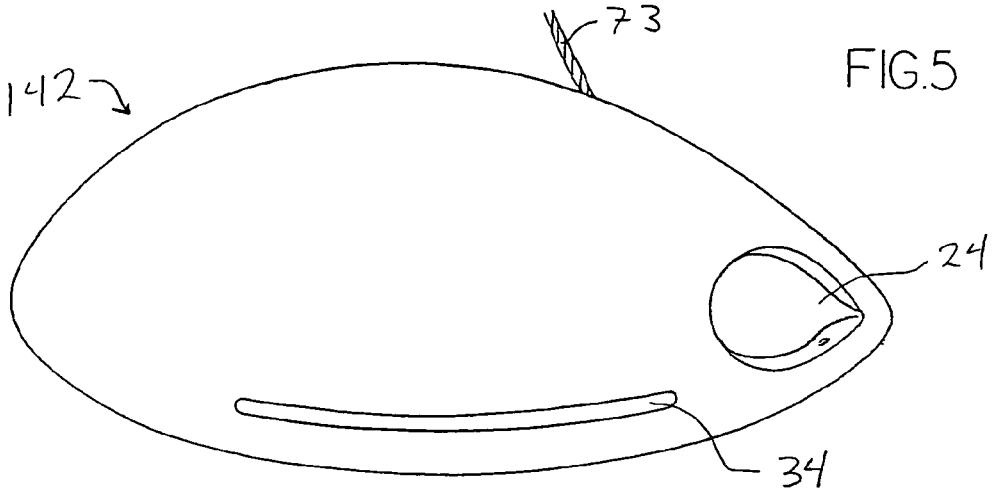
FIG. 5 is a top view of an alternative embodiment of the invented sound pickup system incorporated into a center-mounted oval violin or viola chinrest.
Figure 6:
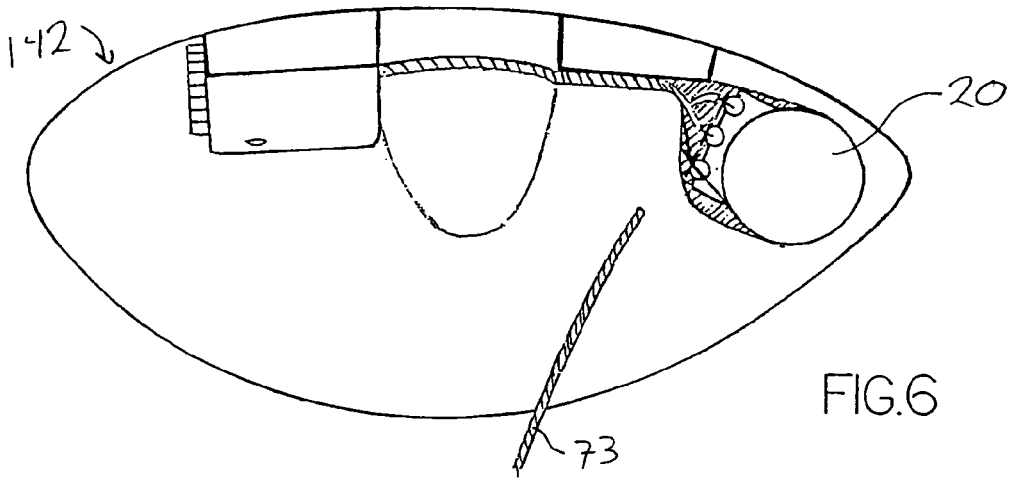
FIG. 6 is a bottom view of the embodiment of FIG. 5.
Figure 7:
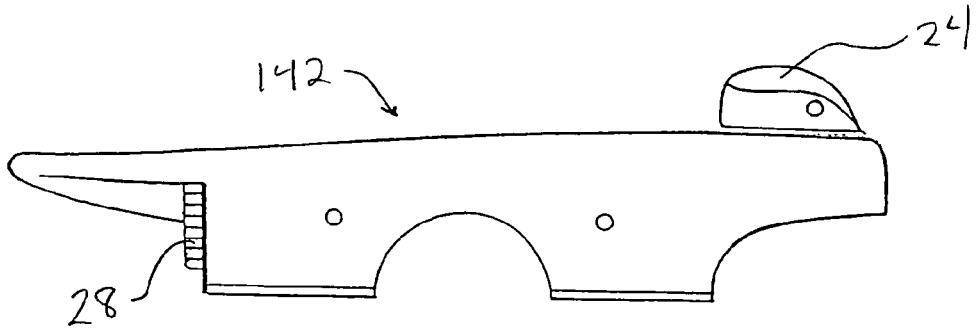
FIG. 7 is a rear view of the embodiment of FIGS. 5 and 6.

Referring to FIGS. 1–4, the preferred embodiment is based on a slightly modified Guarnerius style chinrest 42—an off-center over-the-tailpiece style chinrest. A few of the dimensions are enlarged to allow components of the invented sound pickup system to be embedded therein. Chinrest 42 is attached to the instrument with turnbuckle clamp 36. Any other chinrest may be easily adapted to accommodate the invented sound pickup system as the choice of chinrest type has no real effect on instrument performance—it is based on how the musician prefers to hold and play the instrument. As an example, the sound pickup system is also shown in FIGS. 5–7 embedded in a center-mounted oval chinrest 142.

Figure 14:
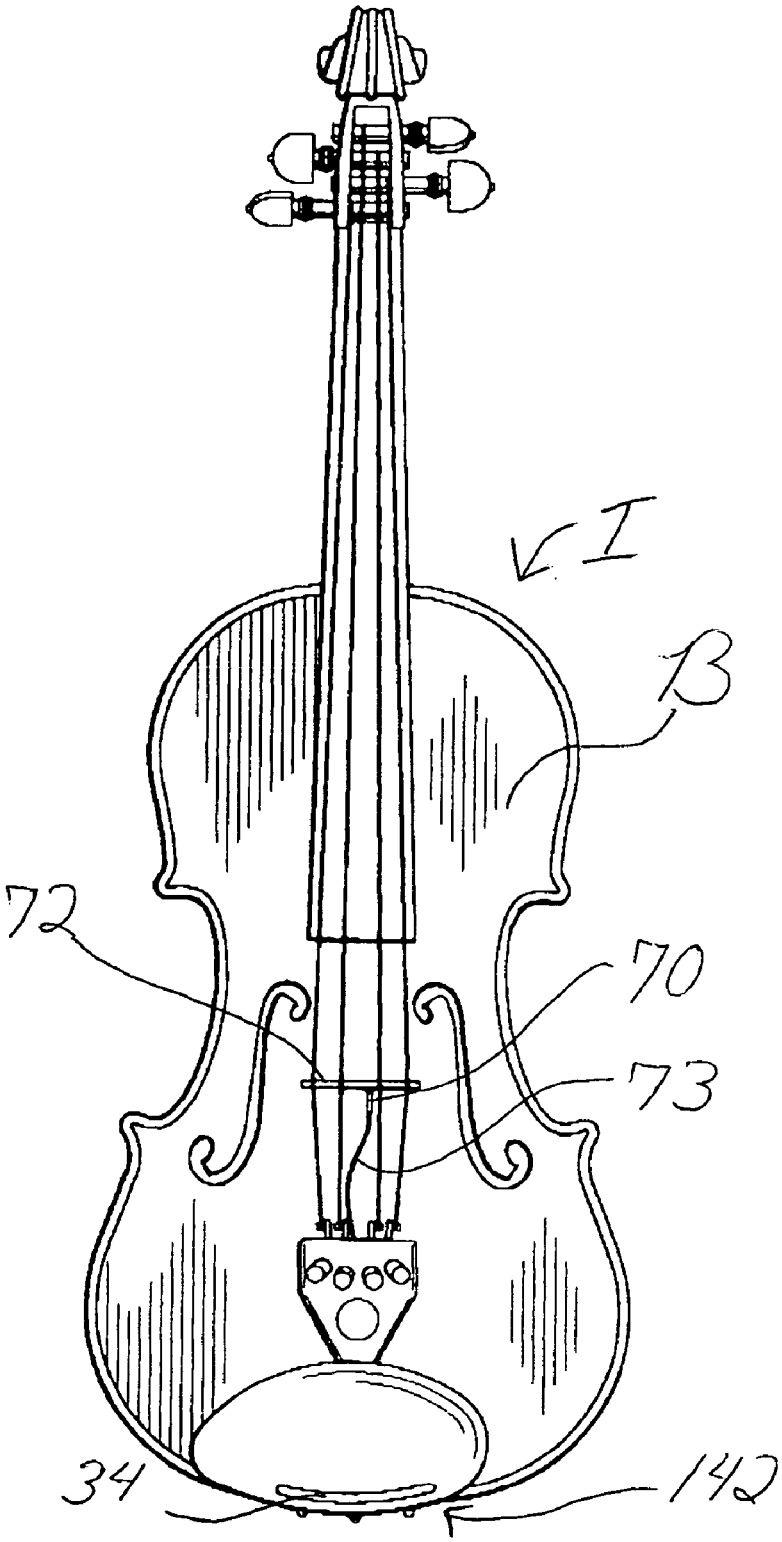
FIG. 14 is a top view of the embodiment of FIGS. 5, 6, and 7 shown on a typical violin.

A first audio interface device 70 is preferably mounted onto instrument bridge 72, as shown in FIG. 14, which may require a slight modification to bridge 72. Any conventional type of audio interface device may be used-e.g., microphones, piezoelectric transducers, and other electromagnetic and electromechanical devices. The preferred sound pickup system uses a piezoelectric transducer, commercially available from various sources such as Fishman and L. R. Baggs, to detect the sound/vibrations and convert it to an electric signal. In the preferred sound pickup system, first audio interface device 70 is wired directly into potentiometer 20 via wire 73.

Figure 9:
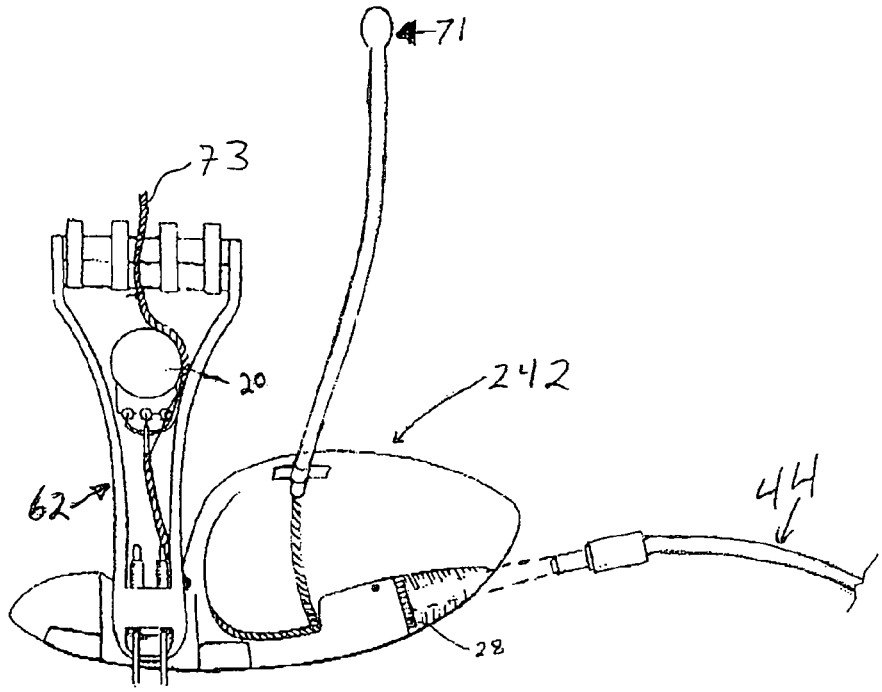
FIG. 9 is a bottom view of the embodiment of FIG. 8.
Figure 10:
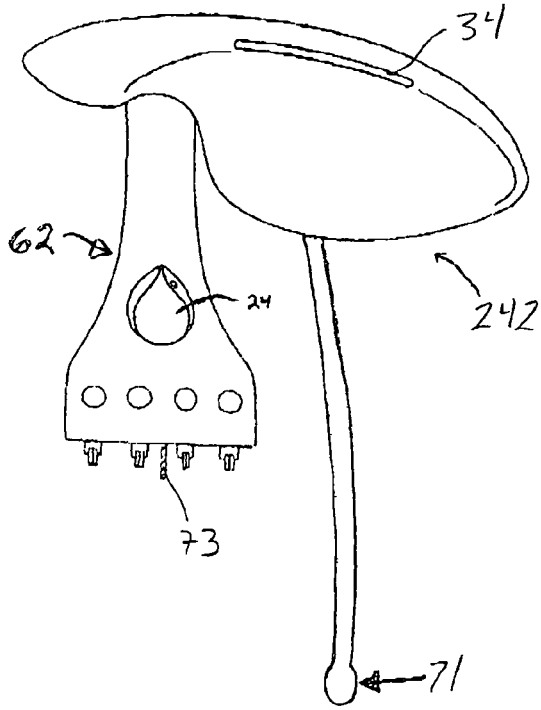
FIG. 10 is a top view of the embodiment of FIGS. 8 and 9.
Figure 13:
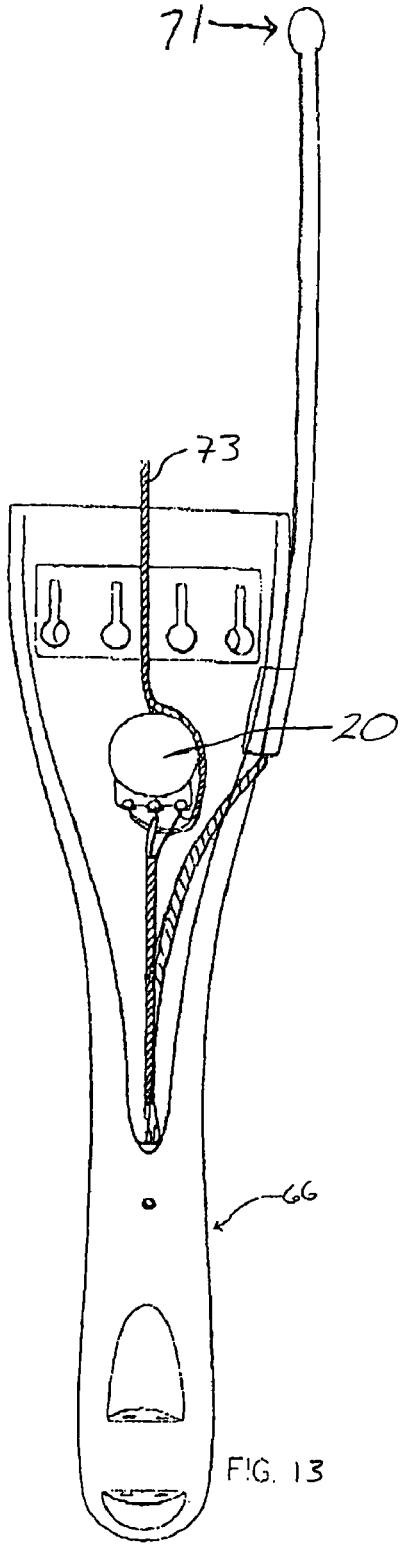
FIG. 13 is a bottom view of the embodiment of FIGS. 11 and 12.

In a more preferred embodiment, a second audio interface device 71—preferably a microphone—is attached to chinrest 42 and extended out over the instrument's sound hole, as illustrated in an alternative embodiment in FIGS. 9 and 10. This way, the sound is picked up from two sources: (1) by first audio interface device 70 located on bridge 72, and (2) by second audio interface device 71 attached to and extending from chinrest 42. Second audio interface device 72 preferably is not connected to or in contact with any portion of the instrument body so that it will not interfere with natural vibration. Preferably, first audio interface device 70 is a piezoelectric transducer and second audio interface device 71 is a microphone. This results in a richer, fuller tone that more closely matches the instrument's natural sound. In an alternative embodiment, second audio interface device 71 may be mounted on the tailpiece. Second audio interface device 71 may be wired directly into the sound output from potentiometer 20, as shown in FIGS. 9 and 13. Preferably, second audio interface device 71 may be wired into a dual phase potentiometer (not shown) that separately controls the volume and sensitivity of both first audio interface device 70 and second audio interface device 71. Alternatively, a second potentiometer (not shown) and control knob (not shown) of the same type as potentiometer 20 and control knob 24 is placed between second audio interface device 71 and output jack 28, where the signals from the two audio interface devices are combined.

Returning to the preferred embodiment of FIGS. 1–4, the sound pickup system preferably includes volume and sensitivity control, which acts as a high frequency filter to eliminate high frequency noises, including bow noises. Control knob 24 is placed on top of chinrest 42, or on another surface of chinrest 42 easily accessible to the musician, and is connected to potentiometer 20, which controls the sound pickup system's volume and sensitivity. The preferred potentiometer 20 is a 1 Mega Ohm, audio taper, ¼ watt, 20% tolerance potentiometer commercially available from Calrad Electronics. Elimination of these undesired noises affords transmission of a more natural tone than with prior sound pickup devices. Noise reduction is accomplished by reducing the audio interface device's sensitivity, which in turn reduces the volume, so that these sounds are not picked up. The preferred potentiometer 20 fulfills its function as a high frequency noise filter when set at or below about ¾ of its full potential. Preferably, potentiometer 20 is placed in recess 21 in the bottom of chinrest 42. Control knob 24 is preferably teardrop shaped so that the user can easily determine and adjust the setting by feel only, but any shape may be used. Non-circular shapes are preferred to achieve a tactile reference point on control knob 24. This feature also allows the amplification to be reduced or eliminated during tuning or when amplification is not desired without the need to remove the sound pickup system or replace it with a different chinrest and/or tailpiece.

The sound pickup system is preferably completely grounded via a human grounding point by inlaying a ground wire 34 in chinrest 42. The preferred inlay wire 34 is a three inch length of 10 gauge copper wire, but conductors of other sizes or materials may be used without exceeding the scope of the invention. This eliminates background electrical interference, improving sound quality. For example, the chinrest body may be carved from ebony, rosewood or other hardwood or molded from plastic or other composite material, while the inlay 34 is copper metal or other conductive material. For example, a 10 gauge copper wire is used to create a grounding inlay which is glued into a grounding inlay mortice so that the left post of the inlay intersects the output jack hole to establish the grounding contact point on the metal housing of the output jack. The grounding inlay running along the top ridge of the chinrest eliminates background electrical interference when touched by the chin as in play while holding the instrument between the chin and the shoulder. As illustrated in the FIGS., and especially FIG. 14, the inlay 34 extends along a portion of a top surface of the chinrest body, near an outer edge of the chinrest body wherein the inlay will likely be contacted by the user's chin. A second human grounding point may be established at the string(s) by connecting a grounding wire (not shown) to the string(s) or fine tuner(s) a technique commonly used in electric guitars. The second grounding point maintains the sound pickup system in a grounded condition when the instrument is being held in hand and no contact is being made with the chinrest ground wire.

Figure 12:
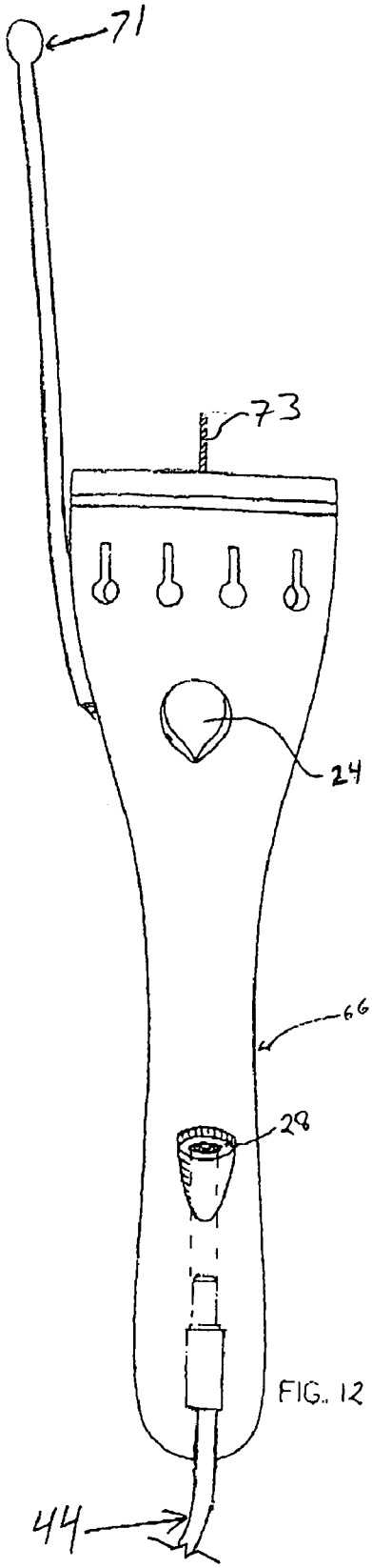
FIG. 12 is a top view of the embodiment of FIG. 11.

Unlike the prior art devices described above, which connect the sound pickup to an amplifier via conventional phone cords, the preferred embodiment uses Mogami shielded low-noise cable 44 (part no. 2333), illustrated with alternative embodiments in FIGS. 9 and 12. A 5.5 OD (outer diameter), 2.1 ID (inner diameter), DC-power type male output jack is attached to cable 44. Cable 44 is smaller and lighter than conventionally used phone cables, reducing the mass and stress on the connection point. Correspondingly, the preferred output jack 28 is a 5.5 OD, 2.1 ID DC-power type female panel output jack (used to transmit an audio signal), but any output jack able to fit into the chinrest, and a mating cable, may be used. The combination of output jack 28 and cable 44 provides a stationary connection point, which is a more reliable connection point than with phone cables; unlike phone cords, cable 44 and output jack 28 are not prone to become temporarily disconnected during movement of the instrument. Placing the sound pickup system in the chinrest also allows cable 44 to be draped over the player's shoulder, keeping it out of the way and largely out of sight. To make the invented sound pickup system compatible with conventional amplifiers and other devices used to receive the sound signal, the terminal end of cable 44 is preferably fitted with a standard ¼" phone jack. Optionally, the invented sound pickup system may easily be modified to operate with wireless transmitters.

Referring to FIGS. 5–7, an alternative embodiment of the invented sound pickup system is shown embodied in a center-mounted oval violin or viola chinrest 142. The sound pickup system is otherwise the same as the preferred embodiment of FIGS. 1–4.

Figure 8:
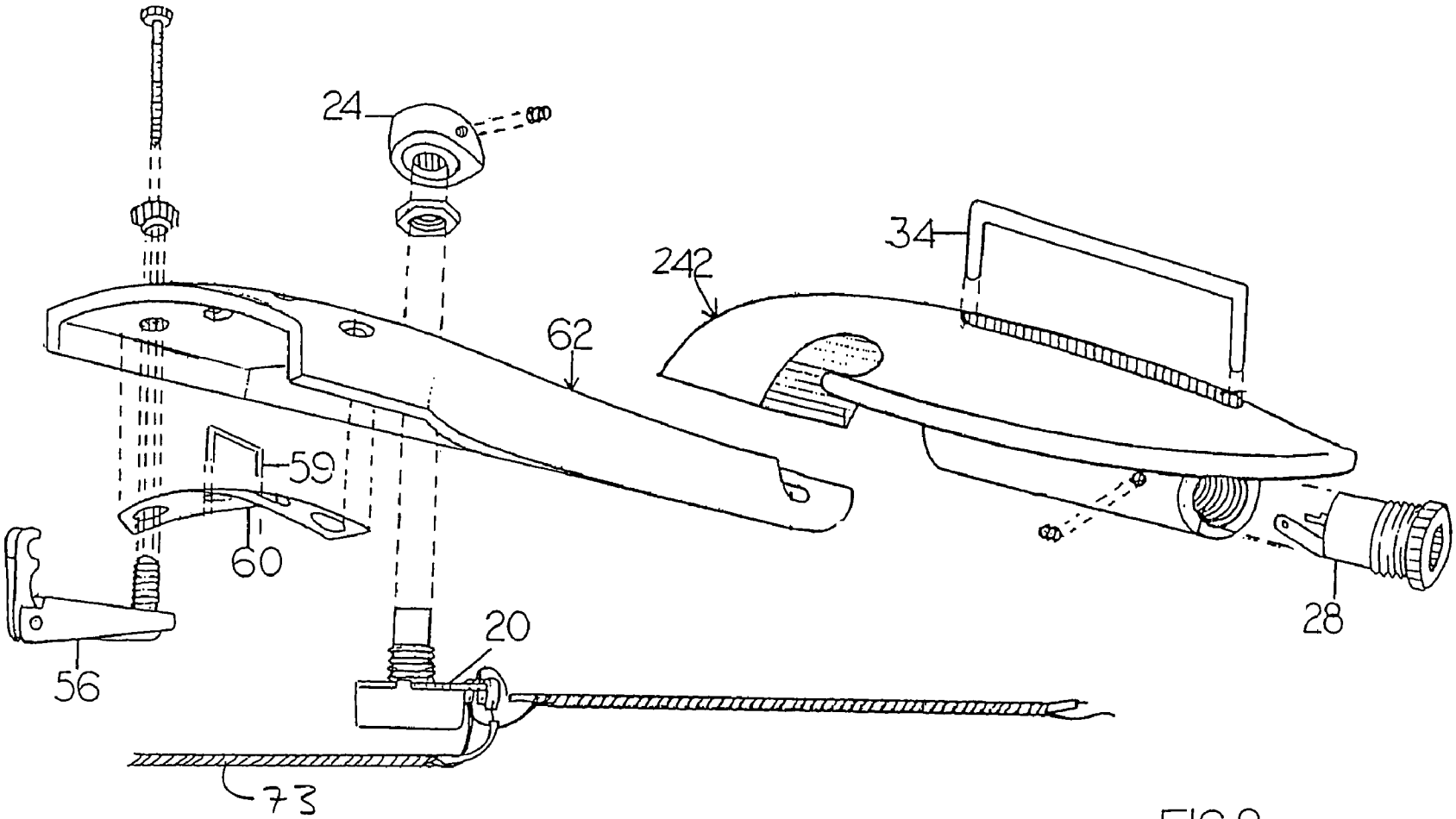
FIG. 8 is an exploded perspective view of the right side of another alternative embodiment of the invented sound pickup system incorporated into a violin or viola chinrest and tailpiece.

Referring to FIGS. 8–10, a second alternative embodiment of the invented sound pickup system is shown embodied in a combination of over-the-tailpiece violin or viola chinrest 242 and tailpiece 62. The sound pickup system is preferably comprised of the same components-e.g., the same first audio interface device 70, second audio interface device 71, wire 73, potentiometer 20, control knob 24, output jack 28, output cable 44, grounding wire inlay 34, etc.—as in the preferred embodiment. To achieve the preferred string grounding, copper grounding plate 60 is held in place by glue and/or standard Wittner fine tuners 56, as illustrated by FIG. 8. Alternatively, a transducer ground wire may be held in place between the second and third string holes and grounds the strings through ground plate 60 and Wittner fine tuners 56 when the strings are touched. Second audio interface device 71 may be attached to and extended from tailpiece 62, in the same fashion as illustrated in FIGS. 12 and 13, or from chinrest 242, as shown in FIGS. 9 and 10. The principle difference between this embodiment and the previously described embodiments is the relocation of control knob 24 and potentiometer 20 from chinrest 242 to tailpiece 62.

Figure 11:
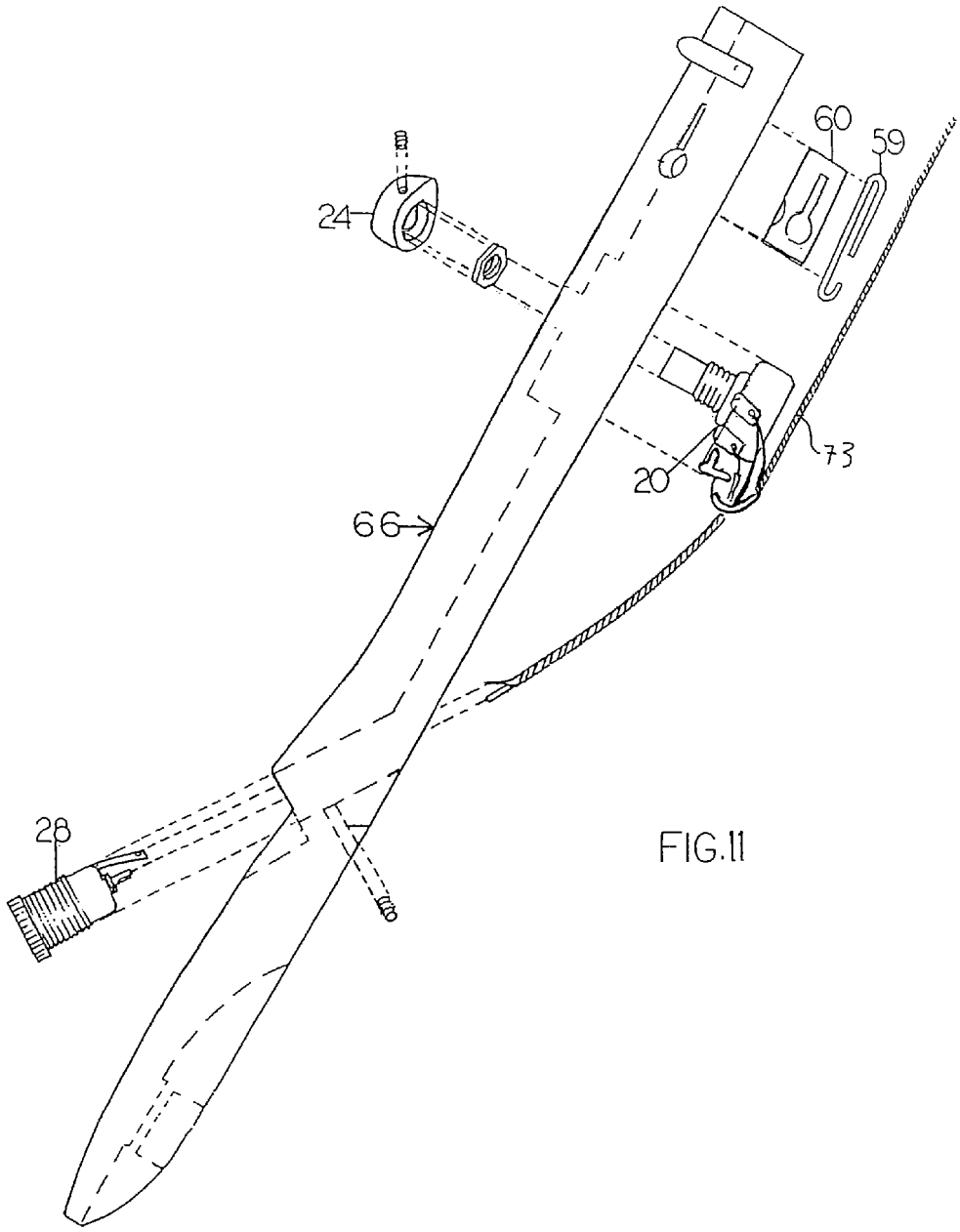
FIG. 11 is an exploded left side view of an alternative embodiment of the invented sound pickup system incorporated into a tailpiece for a cello or bass.

Referring to FIGS. 11–13, an alternative embodiment of the invented sound pickup system is shown embodied with the tail piece for a cello or bass. The sound pickup system is preferably comprised of the same components-e.g., the same first audio interface device 70, second audio interface device 71, wire 73, potentiometer 20, control knob 24, output jack 28, cable 44, grounding plate 60, etc.—as in the preferred embodiment. Output jack 28 is placed in tail piece 66 near the bottom of tail piece 66. Audio interface device 70 is preferably mounted onto the instrument's bridge, in the same fashion as shown in FIG. 14. Grounding is preferably accomplished by attaching copper grounding plate 60 beneath the string holding holes and connecting it to a grounding wire. Second audio interface device 71 may be attached to and extended from tailpiece 62, as shown by FIGS. 12 and 13. The principle difference between this embodiment and the previously described embodiments is that the entire sound pickup system is located in tailpiece 66; there is no chinrest for these large string instruments.

Although this invention has been described in terms of embodiments for certain string instruments, similar devices may be fitted for any other string instruments-e.g., guitars, mandolins, or banjos-without exceeding the scope of the invention and claims.

Although this invention has been described above with reference to particular means, materials, and embodiments, it is to be understood that the invention is not limited to these disclosed particulars, but extends instead to all equivalents within the scope of the following claims.

I claim:

1. A combination of an acoustic string instrument and a clamp-on chinrest, wherein the acoustic string instrument has an acoustic body surrounding and defining a sound chamber, and has strings extending across a bridge, and wherein said chinrest comprises:

a chinrest body a sound pickup system comprising:

a first audio interface device attached to and extending from said chinrest body and attached to or near the bridge of said acoustic string instrument;

volume and sensitivity controller receiving input from said first audio interface device; and an output jack; and a mounting system comprising a clamp removably connecting the chinrest to the acoustic body and said mounting system comprising no alterations to the acoustic body and thereby minimizing interference with vibration of the acoustic body.

2. A combination according to claim 1, wherein said first audio interface device comprises a piezoelectric transducer.

3. A combination according to claim 1, wherein said volume and sensitivity controller comprises a potentiometer and a control knob.

4. A combination according to claim 3, wherein said control knob is non-circular.

5. A combination according to claim 1, further comprising a grounding wire inlaid in said chinrest and extending across an outside surface of said chinrest body and exposed so that it contacts the player during use.

6. A combination according to claim 5, further comprising a second grounding wire extending from said chinrest body and electrically connecting to one or more of said string instrument's strings.

7. A combination according to claim 1, wherein the acoustic stringed instrument acoustic body comprises a sound hole, and the chinrest further comprises:

a second audio interface device attached to and extending from said chinrest body and extending over said sound hole of the acoustic body; and a second volume and sensitivity controller receiving input from said second audio interface device.

8. A combination according to claim 7, wherein said second audio interface device is a microphone.

9. A combination as in claim 1, wherein said clamp is a tumbuckle clamp.

10. A combination as in claim 1, wherein said chinrest body is made from material selected from the group consisting of ebony, rosewood, hardwood, and plastic, and wherein said chinrest further comprises a metal grounding inlay in said chinrest and extending across an outside surface of said chinrest body and exposed so that it contacts the player during use.

11. A combination as in claim 10, wherein said metal grounding inlay is copper.

12. A combination as in claim 10, wherein said acoustic string instrument is a violin and said metal grounding inlay is near an outer edge of a top surface of said chinrest body so that the inlay is adapted to be contacted by a user's chin when said user is playing the violin.

13. A combination as in claim 10, wherein an end of said metal grounding inlay extends to contact a metal housing of said output jack.

* * * * *